US007998550B2

(12) United States Patent
Boatwright et al.

(10) Patent No.: US 7,998,550 B2
(45) Date of Patent: Aug. 16, 2011

(54) STITCHLESS ON-SITE BINDING APPLICATION METHOD

(75) Inventors: Ben E. Boatwright, Cartersville, GA (US); Kelly Huddleston, La Junta, CO (US)

(73) Assignee: Bond Products, Inc., Philadelphia, PA (US)

( * ) Notice: Subject to any disclaimer, the term of this patent is extended or adjusted under 35 U.S.C. 154(b) by 0 days.

(21) Appl. No.: 11/968,580

(22) Filed: Jan. 2, 2008

(65) Prior Publication Data

US 2008/0182064 A1 Jul. 31, 2008

Related U.S. Application Data

(60) Division of application No. 10/665,467, filed on Sep. 22, 2003, now Pat. No. 7,329,324, which is a continuation of application No. PCT/US03/20418, filed on Jun. 30, 2003.

(60) Provisional application No. 60/392,261, filed on Jul. 1, 2002, provisional application No. 60/411,347, filed on Sep. 18, 2002.

(51) Int. Cl.
*B32B 3/04* (2006.01)
*B32B 7/10* (2006.01)

(52) U.S. Cl. ..... 428/122; 428/88; 428/82; 428/192; 428/346

(58) Field of Classification Search ..... 428/88, 428/121, 122, 123, 115, 192, 343, 346, 352, 428/82; 16/4, 7, 8
See application file for complete search history.

(56) References Cited

U.S. PATENT DOCUMENTS

| | | | | |
|---|---|---|---|---|
| 2,553,765 | A * | 5/1951 | Higgins et al. | 156/295 |
| 3,616,147 | A * | 10/1971 | Ambrose | 428/365 |
| 3,622,433 | A * | 11/1971 | Clark | 428/123 |
| 4,054,698 | A | 10/1977 | Hamrah | |
| 4,724,327 | A | 2/1988 | Mitchell | |
| 4,859,524 | A | 8/1989 | Kim et al. | |
| 5,468,533 | A * | 11/1995 | Lipson | 428/41.7 |
| 5,654,035 | A * | 8/1997 | Ljungberg et al. | 427/255.34 |
| D394,776 | S * | 6/1998 | Callas | D6/587 |
| 6,093,469 | A * | 7/2000 | Callas | 428/95 |
| D439,462 | S * | 3/2001 | Callas | D6/587 |
| 6,258,202 | B1 | 7/2001 | Callas | |
| 6,517,922 | B2 * | 2/2003 | Ang et al. | 428/41.8 |
| 6,582,797 | B1 * | 6/2003 | Gunter et al. | 428/123 |
| 6,703,097 | B2 * | 3/2004 | Moffat Devine et al. | 428/41.8 |
| 6,974,616 | B2 * | 12/2005 | Perez | 428/40.1 |
| 7,329,324 | B2 * | 2/2008 | Boatwright et al. | 156/88 |
| 7,422,044 | B1 * | 9/2008 | Perez | 156/443 |
| 7,425,079 | B2 * | 9/2008 | Bruce et al. | 362/84 |

(Continued)

FOREIGN PATENT DOCUMENTS

DE 2207453 A * 9/1972

(Continued)

*Primary Examiner* — Cheryl Juska
(74) *Attorney, Agent, or Firm* — Howson & Howson LLP

(57) ABSTRACT

On-site binding for carpets and the like wherein a covered welting material is provided with a strip with adhesive on both sides. One side is covered with peel-off wax paper which is removed to adhere the welting material flush against the edge of the carpet's pile. The adhesive underside of the paper has an extension of the welting material adhered thereto. A thermal plastic glue is applied between the carpet pile and welting material whereby the welting material binding is secured the carpet by the underlying strip (with adhesive on both sides) and the thermal plastic bead.

5 Claims, 2 Drawing Sheets

U.S. PATENT DOCUMENTS

| | | | | |
|---|---|---|---|---|
| 7,753,543 | B2 * | 7/2010 | Hsu et al. | 362/97.1 |
| 2001/0001300 | A1 | 5/2001 | Tolbert et al. | |
| 2002/0102376 | A1 | 8/2002 | Ang et al. | |
| 2004/0121129 | A1 * | 6/2004 | Perez | 428/194 |
| 2004/0166285 | A1 * | 8/2004 | Perez | 428/122 |
| 2005/0034803 | A1 * | 2/2005 | Boatwright et al. | 156/88 |
| 2008/0182064 | A1 * | 7/2008 | Boatwright et al. | 428/95 |
| 2010/0035056 | A1 * | 2/2010 | Perez | 428/343 |

FOREIGN PATENT DOCUMENTS

| | | | |
|---|---|---|---|
| JP | 2002137694 | A * | 5/2002 |
| WO | WO 2004008921 | A1 * | 1/2004 |

* cited by examiner

METHOD OF APPLICATION

STEP1: PEEL WAX PAPER TO EXPOSE GLUED SIDE OF BINDER.

STEP2: ATTACH TO BOTTOM OF CARPET AND ABUT CORD TO SIDE OF CARPET.

STEP3: SEPARATE CORD FROM EDGE AND APPLY A BEAD OF THERMOPLASTIC GLUE USING A HOT GLUE GUN.

STEP4: ATTACH EDGE BINDING TO EDGE OF CARPET BY FOLDING THEM TOGETHER TO FORM A SEALED BOND.

STITCHLESS ON-SITE BINDING APPLICATION METHOD

CROSS-REFERENCE TO RELATED APPLICATIONS

This application is a division of application Ser. No. 10/665,467, filed Sep. 22, 2003, now U.S. Pat. No. 7,329,324, issued Feb. 12, 2008, said application Ser. No. 10/665467 being a continuation of International Application No. PCT/US03/20418, filed Jun. 30, 2003, which claimed the benefit, under 35 USC §119(e) of provisional applications 60/392,261, filed Jul. 1, 2002 and 60/411,347, filed Sep. 18, 2002, the benefit of both of which is also claimed herein.

FIELD OF THE INVENTION

The present invention relates to the field of binding, particularly a stitchless on-site binding application for finishing the cut edge of a piece of material such as carpet.

BACKGROUND OF THE INVENTION

Cut carpet edges are known to fray and delaminate at the edge if they are not finished or bound in some manner. Custom fitted carpets commonly referred to in the art as "wall to wall" are ordinarily tacked down along the edge of a wall or other boundary using a tack down strip or similar device to bind the unfinished edge of a carpet against a boundary such as wall or molding. Carpets which are not fitted to a boundary such as a wall, should be bound at the edge to prevent fraying of the cut carpet pile, delaminating of the carpet edge construction, and general degradation of the carpet end due to normal wear and tear.

Carpet bindings are known in the art designed to finish the edges of carpets and carpeting which are to be fitted not in a wall-to-wall manner and therefore have edges exposed to ordinary wear and tear. Area carpets placed on a wood floor are often not fitted wall-to-wall and the edges thereof are ordinarily bound by a stitched binding method using carpet binding methods and materials known in the art.

U.S. Pat. No. 2,037,511, to Jackson, discloses a carpet binding wherein a pocket is created by folding a piece of fabric over itself on one end using either adhesive or stitching, or both, inserting a metal bar into the pocket and stitching the end of the pocket to prevent sliding or dislocation of the metal bar. The weighted metal bar prevents curling of the carpet end.

United States patents and at least one International published application disclose carpet bindings and welting materials and methods for finishing the edge of a piece of material such as carpet. Reference is made to U.S. Pat. No. 1,879,258, to Howard; 324,082, to Charmbury; Reissue 36,636, to Sturm et al; 4,724,327, to Mitchell; 2,066,545, to Shuttleworth; 2,855,027, to Bank; 3,592,720, to Wattles et al; and International Publication No. WO 88/06666, to Jodeit et al. In each case, similar to U.S. Pat. No. 2,037,511, to Jackson, the use of stitching is encouraged or required to secure the binding material in a manner designed to improve the bind.

Stitched bindings on carpet edges provide a secure bind and at the same time provide a uniform finished look for aesthetic appeal and greater value. However, due to the thick nature of the backing material used to manufacture carpets, a strong needle is required to sew binding on carpet. Therefore carpet bindings are constructed on heavy duty sewing machines in a factory or commercial establishment prior to the finished product being delivered to the home, office, or final installation location.

The installation of custom wall-to-wall carpets often results an excess amount of carpet waste due to the oversizing required to fit the carpet wall-to-wall and the natural widths which the carpet material is manufactured and rolled. This excess carpet is frequently saved by the consumer and used for small area rugs, cut to fit closet interiors, and can be cut to fit the central-used portion treads and rises of a stairway. However, the unfinished edges of these excess carpet pieces, also know as remnants when sold as the large last section of a carpet roll, are not bound and are therefore subject to the aforementioned problems of fraying, delaminating, and degradation. Customers can request that remnants be bound for them prior to installing. The cost of binding a carpet with a traditional stitched binding is currently typically about one to two dollars per foot. Once presented with sufficient remnants to install an area such as a stairway, customers have an option of resending the carpet pieces to the factory for custom binding. The cost associated with a second delivery and the additional cost of the binding may be avoided if carpet installers can readily provide a stitchless on-site binding application performed at the installation location without the need for custom sewing or machinery or the extra time associated with a second delivery.

SUMMARY OF THE INVENTION

It is an object of this invention to provide a method and materials for binding the edge of a carpet which improves upon binding methods known in the prior art and the disadvantages of the known methods that require stitching to prevent fraying, delaminating, and degradation. The instant invention binds without the requirement of stitching at the installation location using a method which is easily applied and transportable to any location thereby making it less expensive and easier to make a finished edge on carpet remnants and provide a finished bound edge on carpeting.

It is a further object of this invention to provide a method and materials to carpet installers for customizing the ends of unfinished carpets with a quick and easy stitchless on-site binding application that can be color-coordinated to match different carpet colors and coordinated to offer different binding sizes and textures for greater aesthetic appeal.

Another feature of this invention is the stitchless on-site binding material comprising a double-sided adhesive means which secures the bound edge to the carpet adjacent to the carpet material terminus and which also secures the bottom edge of the carpet or otherwise tends, to immobilize it onto the floor or substrate on which the carpet rests.

The welt material may also be formed from any commercially prefabricated edge material using conventional binding means such a stitching or adhesive, for example, a sewn rope or fringe which may next be affixed onto the binding fabric using the disclosed invention. The binding fabric with the prefabricated welted material is bound to the exposed edge of the carpet using the stitchless on-site binding application described herein.

The on-site binding is doubly secured to the adjacent carpet material by the application of a thermoplastic glue between the carpet material and the welt material above the adhesive means which connects and underlies the welt material and the carpet material.

DETAILED DESCRIPTION OF THE PREFERRED EMBODIMENTS OF THE INVENTION

Figure 2:
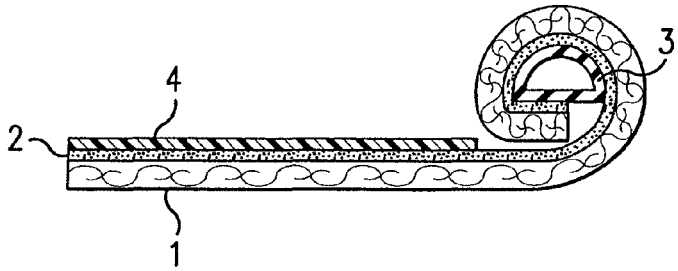
FIG. 2 is a side elevation view of the stitchless binding device without the carpet material to be bound.

Referring now to the drawings, and particularly FIG. 2, a side elevation view of the stitchless binding device for finishing a material comprising a carpet having a pile 7. It will be appreciated, however, that the binding device can be used on upholstery, window treatments such as cornices, pillows, and other materials requiring binding to finish an edge.

Binding fabric 1 is covered with a double-face adhesive layer 2 on at least one side. Double-face adhesive layer 2 is commonly referred to as a "peel and stick" double-face tape with adhesive coatings on both sides covered by a thin non-stick peelable film 4. The width of the binding fabric is approximately two and one-half inches (2½) although different widths may be used depending on the application and materials used.

Figure 1:
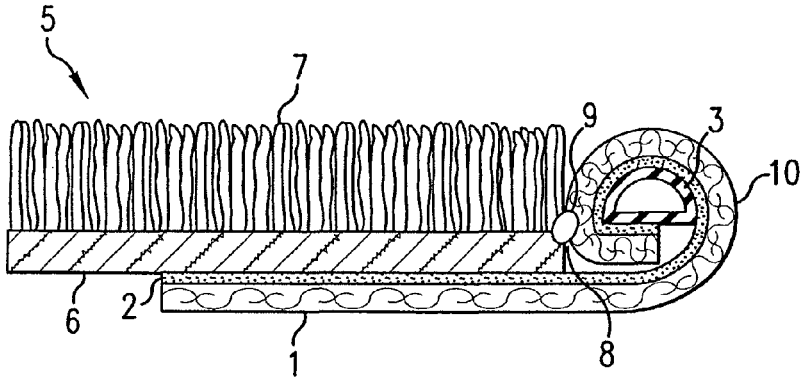
FIG. 1 is a side elevation view of a carpet with the stitchless binding device installed.

Welt material 3 is pre-formed from a flexible material such a rubber into a semi-circular shape and is readily available in preformed rolls used for binding which is traditionally stitched to the edge of a carpet 5. Adhesive layer 2 is partially exposed to allow the end of the joined layers of binding fabric 1 and adhesive layer 2 to secure and stick to the covered welt material 3 as shown in FIGS. 1 and 2. However, a preferred method of securing the formed welt 10 to backing 6 is illustrated in FIGS. 3 and 6-8, wherein adhesive layer 2 is secured preferable about the middle or mid-point of the diameter of the flat side of the covered welt material 3. Welt material 3 may have an adhesive pre-applied to its flat side for easier securing to the fabric and stronger adhesive seal. The combined welting material 3 together with the binding fabric 1 and adhesive layer 2 is rolled over to secure welt material 3 in an upright position with the curved portion topside creating a rounded edge with, as seen in the FIG. 3 embodiment, a flat bottom. This step can be conducted on site in the situation where a seldom-used color or binding fabric or welting material is used. In the instances where common binding fabric colors and welting material are used, the structure shown in FIG. 2 or FIG. 3, can be prepared in advance in anticipation of later use by the disclosed method or methods already known in the art. For example, welting material 3 can also be sewn into binding fabric 1 or secured by adhesive which is not a peel and stick double face variety. However, the peel and stick double face tape is adhered to the binding fabric 1 from the inner edge of the welting/binding fabric formed for subsequent adhering to the carpet or material to be bound.

Referring now to FIG. 1, carpeting or material 5 comprises backing 6 (primary and secondary) and pile material 7. To begin the binding process of material 5, the peel and stick plastic coating 4 is removed to expose the adhesive 2. Backing 6 of material 5 is placed onto adhesive 2 being careful to abut the edge of pile 7 to the interior portion of the formed welt 10 at edge location 8 thereby creating an artificial boundary which serves to protect against degradation. A bead of thermoplastic adhesive 9 is placed in-between the welt 10 at edge location 8 and the ends of pile 7 further securing the binding. Thermoplastic adhesive 9 may be pre-applied to welt 10. During installation the pre-applied thermoplastic adhesive 9 may be activated by a heating means designed to melt the adhesive to allow the welting material and the edge of the carpet to become bound. Heating means could comprise irons, hot-air blowers, and non-heat radiation applied to an element contained within the thermoplastic designed to melt the thermoplastic by radiation such as a microwave. In the latter embodiment a metal element is contained within or against the thermoplastic 9 and activated by a radiating means which causes the element to heat and thereby melt the thermoplastic.

Figure 3:
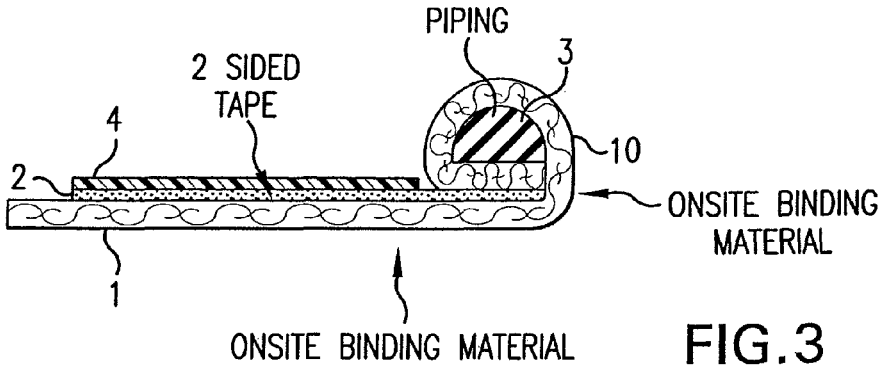
FIG. 3 is similar to FIG. 2 including, however, the addition of protective wax paper above and below the two-sided adhesive tape.

FIGS. 3 and 6-8 illustrate the method of applying the invention to the edge of a carpet or the like. Thus in FIG. 3 the invention as ready for installation on a carpet or like is shown wherein the two-sided tape 2 is covered by wax paper 4. For insulation, tape 4 is removed thus exposing adhesive 2 applied to fabric 1. Both fabric 1 with adhesive layer 2 thereon being secured under welt 10 with fabric 1 being wrapped around piping 3. This structure, as shown in FIG. 3, is then placed under backing 6 of carpeting 5 so that backing 6 is secured to fabric 1 via adhesive 2. Thermal plastic is then applied between welt 10 pile material 7 at location 8. The glue is preferably, as previously indicated, thermoplastic glue and is applied with a hot glue gun. Then welt 10 is folded together against the edge of carpeting 5 from the position shown in FIG. 7 to that shown in FIG. 8, and allowed to cure (usually about 5 to 10 seconds) to form a secured bond.

Figure 4:
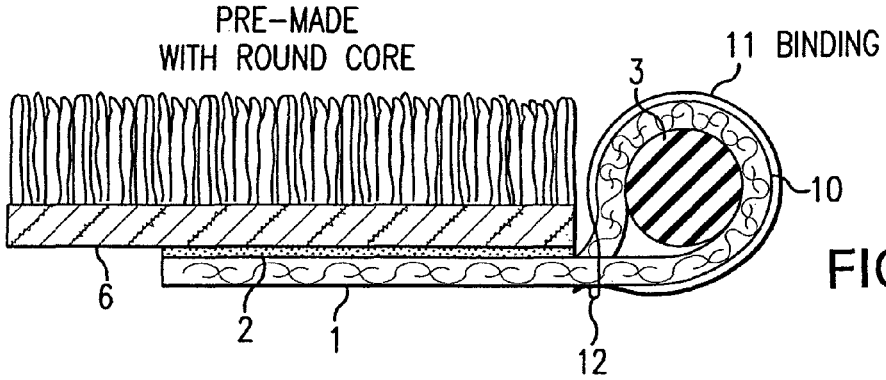
FIG. 4 is also similar to FIG. 2, which disposes an alternative cylindrical piping in place of the "D" piping shown in FIGS. 2 and 3.
Figure 5:
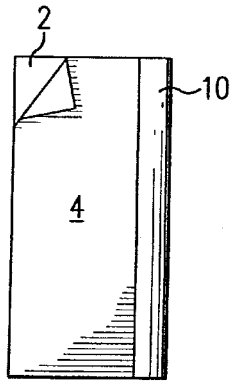
FIG. 5 is a plan view of the peel-away wax paper which covers the two-sided adhesive tape.
Figure 6:
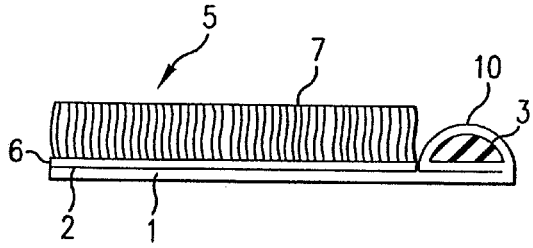
FIG. 6 is similar to FIG. 1 without, however, the thermal plastic glue having been applied.
Figure 7:
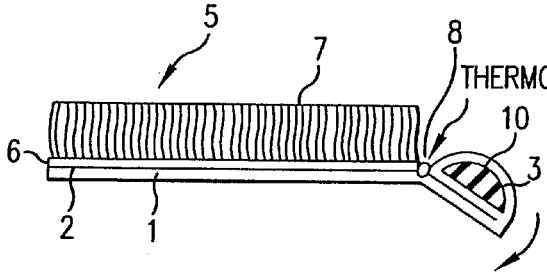
FIG. 7 is the same as FIG. 6 illustrating, however, the binding material bent over to receive the thermal plastic glue which is introduced between the carpet backing and lower part of the carpet pile by a hot glue gun.
Figure 8:
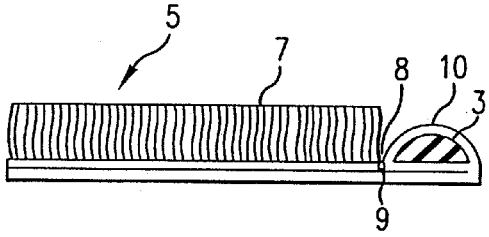
FIG. 8 illustrates the next step following the introduction of the glue shown in FIG. 7, wherein the binding is folded against the carpet backing and lower portion of the carpet pile to form a sealed bond which, with the thermal plastic glue being cured, forms the final product.

FIG. 4 shows a somewhat different embodiment wherein piping 3 is cylindrical in shape, thus having a circular cross-section and welt 10 includes a binding 11 which is secured to fabric 1 by being pre-sewn thereto by stitching 12. This structure is prepared by the manufacturer and then applied on site in the same manner as shown for the structure in FIG. 3.

The product and method of applying the binding to carpeting is currently being advertised using the trademark "INSTABIND." On the Internet at http://www.instabind.com and the disclosure of such advertising is incorporated herein by reference. Copies of such material published on the Internet are submitted herewith for information.

The flexible stitchless on-site binding disclosed can be used via the wrap-curl steps or otherwise bent and curved to address form-fitting applications such as bull-nose shapes and upholstery forms. Additional embodiments of this invention can be used to incorporate fringe instead of binding fabric and welting. Further, the adhesive means can be alternated with methods known in the art such as Velcro, iron-on adhesive and hot glue. The advantages of the instant invention are designed to allow for quick and portable binding in a secure and attractive manner without the costs ad time associated with traditional known binding means and devices.

Binding fabric 1 may have a non-slip bottom surface or may be eliminated whereupon layer 2 abuts the supporting surface in which case the bottom of layer 2 may have a non-slip surface applied thereto as well as a bead 9 of thermoplastic also applied thereto in the manufacturing step or on-site.

The foregoing disclosure illustrates the preferred embodiments of the invention; however, concepts as based upon the disclosure, may be employed in other embodiments without departing from the scope of the invention. Accordingly the following claims are intended to protect the invention broadly, as well in the specific forms shown.

The invention claimed is:

1. A binding material comprising a fabric having an elongated portion capable of underlying a marginal area of a carpet, said portion having a top surface engageable with a bottom surface of said carpet, said top surface having a first pre-applied adhesive for adhering said portion of the fabric to said bottom surface of the carpet, and welting material integrally connected to, and extending upward along an edge of said portion of the fabric, said welting material having a second pre-applied adhesive positioned to abut an edge of said carpet adjacent said marginal area when said portion of the fabric is adhered to said bottom surface of the carpet, for permanently binding said welting material to said carpet edge.

2. The combination of a material to be bound and an elongated binding material for application to a margin of the material to be bound, the binding material comprising an elongated strip of binding fabric having a top side, a two-sided adhesive tape having a lower side adhering to said top side of said fabric strip via an adhesive on said lower side of the tape, and an upper side of said tape temporarily adhering to the lower side of said margin of the material to be bound via an adhesive on said upper side of the tape, a welting material secured to said binding fabric strip along an edge thereof adjacent an edge of the material to be bound, the welting material and said fabric strip abutting said edge of the material to be bound, and a bead of adhesive permanently securing said edge of the material to be bound to said binding material.

3. The combination of binding material and material to be bound as claimed in claim 2, wherein the welting material is a fringe.

4. The combination of binding material and material to be bound as claimed in claim 2, wherein the welting material is a rope.

5. The combination of binding material and material to be bound as claimed in claim 2, wherein the welting material is secured in a pocket formed by bending said binding fabric on one end of said binding fabric over itself.

* * * * *